United States Patent [19]

Palibroda

[11] Patent Number: 4,891,919

[45] Date of Patent: Jan. 9, 1990

[54] CONTAINERIZED TRANSPORTABLE HOUSE

[76] Inventor: James W. Palibroda, 221-5th Street, Prince Rupert, British Columbia, Canada, V8J 3T2

[21] Appl. No.: 181,990

[22] Filed: Apr. 15, 1988

Related U.S. Application Data

[63] Continuation-in-part of Ser. No. 940,529, Dec. 10, 1986.

[51] Int. Cl.[4] ..... E04H 1/00; E04H 14/00

[52] U.S. Cl. ..... 52/79.5

[58] Field of Search ..... 52/79.5, 143, 64, 66, 52/70, 71, 702, 289

[56] References Cited

U.S. PATENT DOCUMENTS

| | | | |
|---|---|---|---|
| 559,965 | 5/1896 | Bierstadt | 52/69 |
| 1,417,736 | 5/1922 | Heygate | 52/69 |
| 1,765,107 | 6/1930 | Snyder | 52/702 |
| 3,236,014 | 2/1966 | Eigar | 52/92 |
| 3,462,897 | 8/1969 | Weinrott | 52/169.14 |
| 3,500,597 | 3/1970 | McKenzie | 52/92 |
| 3,517,962 | 6/1970 | Bassett | 52/64 |
| 3,755,974 | 9/1973 | Berman | 52/220 |
| 3,792,558 | 2/1974 | Berce et al. | 52/79.5 |
| 3,832,811 | 9/1974 | Briel | 52/79.5 |
| 3,983,665 | 10/1978 | Burton | 52/71 |
| 4,726,158 | 2/1988 | Fagnoni | 52/143 |

*Primary Examiner*—James L. Ridgill, Jr.

*Attorney, Agent, or Firm*—Christie, Parker & Hale

[57] ABSTRACT

A containerized home for shipping unassembled in a standard size cargo shipping container is disclosed. It is comprised of a housing having first and second longitudinal side walls, first and second end walls, a bottom and top section, said first and second end walls of said housing being fixedly mounted to said bottom section to form part of a first and second side wall of said home, said first and second longitudinal side walls of said housing being pivotably mounted along a first edge to said bottom section of said housing to form with said bottom section a base frame of said home, said top section being fixedly mounted to said first and second end walls to form part of a second floor plan of said home; a plurality of frame composite panels suitably stored in said housing to form remaining sections of said side walls, front and rear walls and roof section of said home.

7 Claims, 9 Drawing Sheets

10
13
14
11

10
13
14
11

201
202
11
50

15
51
13

CONTAINERIZED TRANSPORTABLE HOUSE

CROSS REFERENCE TO RELATED APPLICATIONS

This application is a continuation-in-part of application Ser. No. 940,529 filed Dec. 10, 1986, the disclosure of which is incorporated herein by reference.

FIELD OF THE INVENTION

This invention relates to portable homes and more particularly a portable house which can be shipped unassembled and constructed from a standard "high cube" steel shipping container.

DESCRIPTION OF THE PRIOR ART

Most of todays prefabricated houses are assembled at a factory and transported as either a single unit or two separate sections. These are usually transported or towed by a truck or tractor and later combined or assembled on the construction site.

Such a foldable and transportable home is disclosed in U.S. Pat. No. 3,983,665. This portable home is comprised of two foldable sections which are transported in their folded conditions, placed on a foundation and later joined rigidly together after erecting the walls.

With this design, a certain amount of prefabrication is required before the house can be shipped to its final destination. Accordingly, care must be taken when the sections of the house are transported on the highway by conventional means.

Accordingly, there exists a requirement for a fully transportable house which is shipped in unassembled form in a container.

SUMMARY OF THE INVENTION

It is therefore the principal object of the present invention to provide a containerized home, which in its unassembled state will have the size of a standard sealand "high cube" steel shipping container.

Another object of the present invention is to provide a containerized home in which the steel shipping container is used as the main support for the structure of the home.

And yet another object of the present invention is to provide a containerized home in which the steel walls of the container will unfold, with composite panels being withdrawn from their storage places and reassembled as they are attached to form the outer walls and room sections of the home.

Accordingly, the present invention provides a containerized home for shipping unassembled in a standard sized "high cube" steel cargo shipping container comprising: a housing having first and second longitudinal side walls, first and second end walls, a bottom and top section, said first and second end walls of said housing being fixedly mounted to said bottom section to form part of a first and second side wall of said home, said first and second longitudinal side walls of said housing being pivotably mounted at a first edge to said bottom section of said housing to form with said bottom section a base frame of said home, said top section being fixedly mounted to said first and second end walls to form part of a second floor plan of said home; a plurality of composite panels suitably stored in said housing to form remaining sections of said side walls, front and rear walls and roof section of said home.

DRAWINGS

Particular embodiments of the invention will be understood in conjunction with accompanying drawings in which.

Figure 3A:
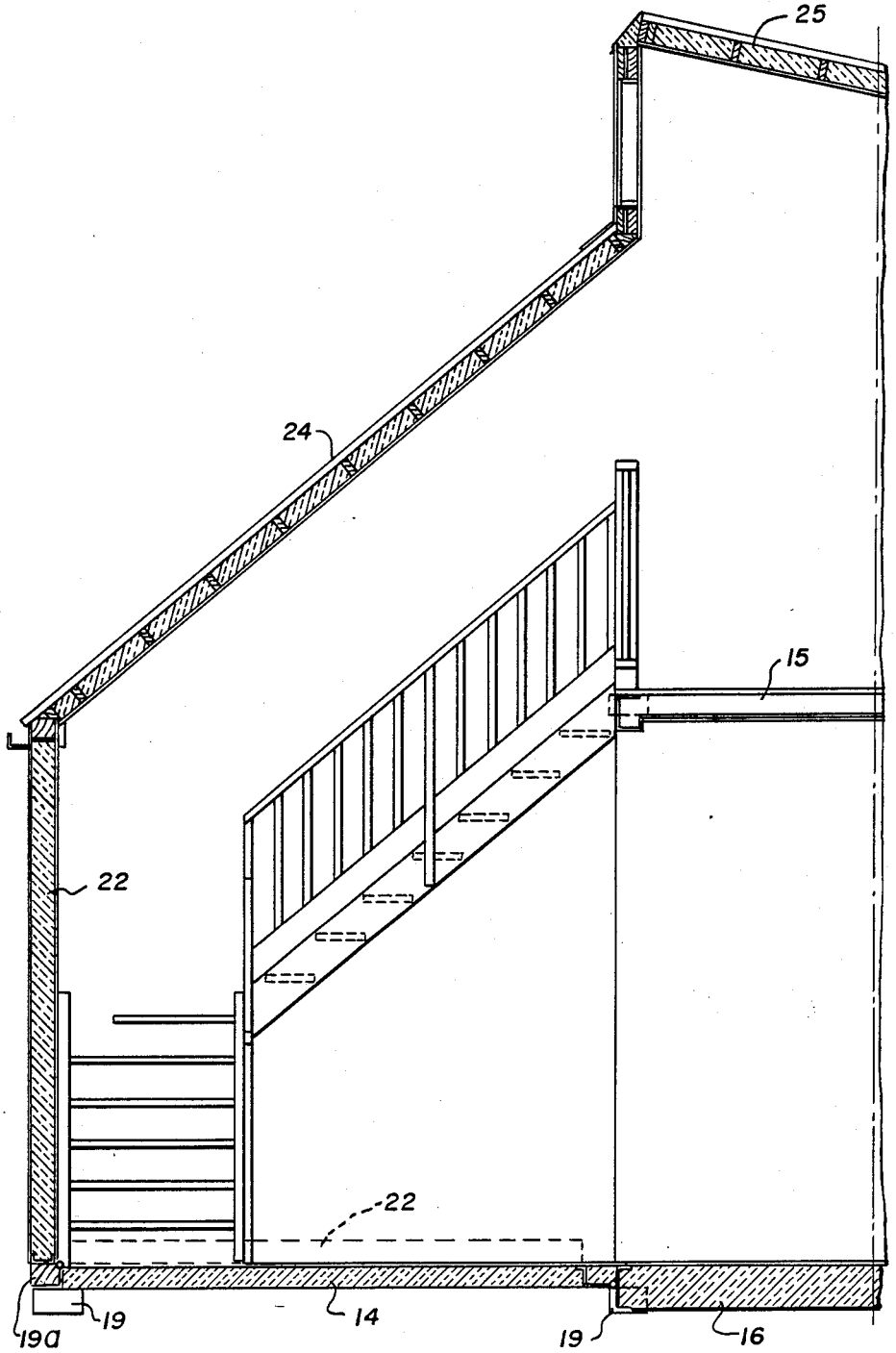
Figure 3B:
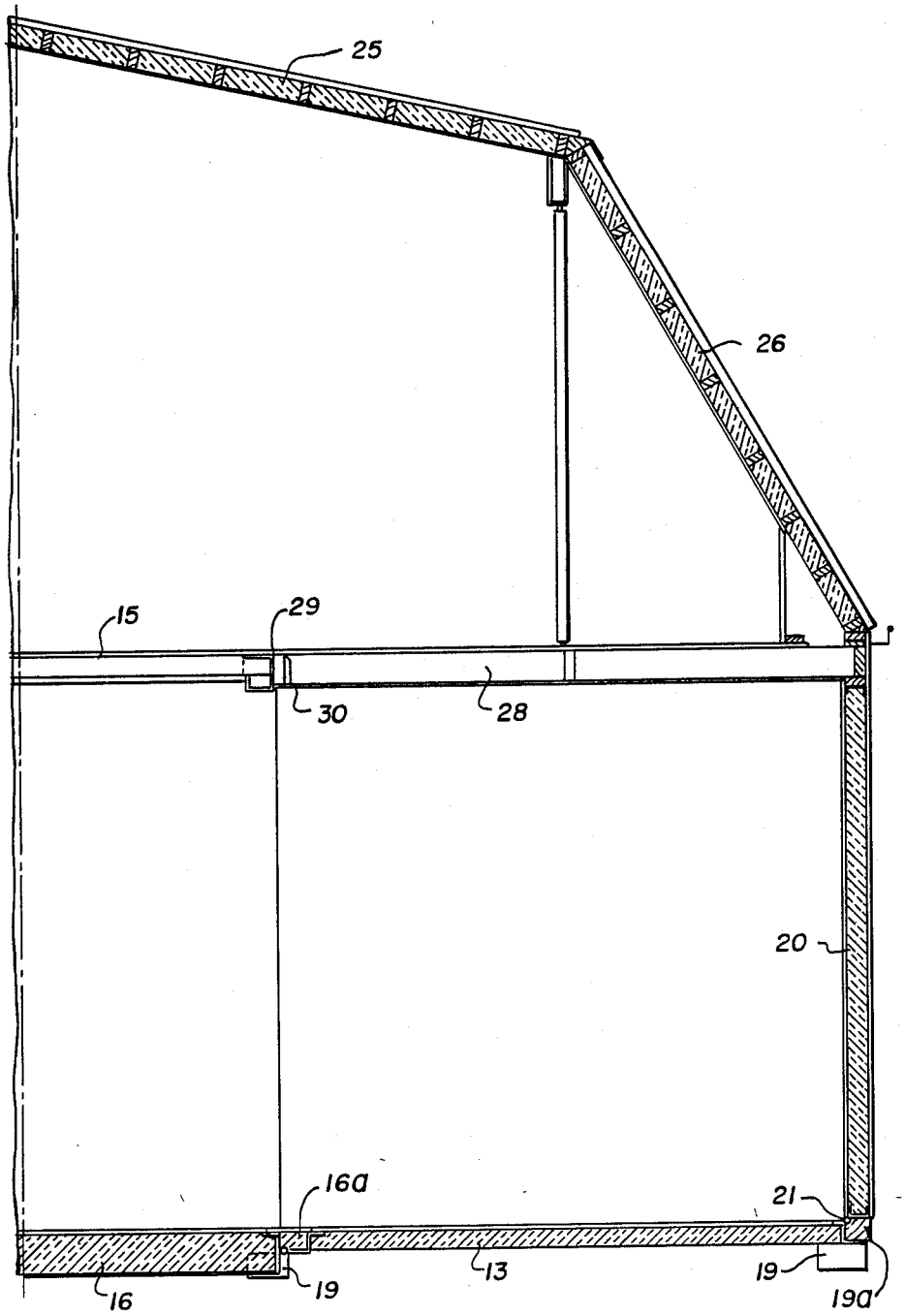
Figure 5:
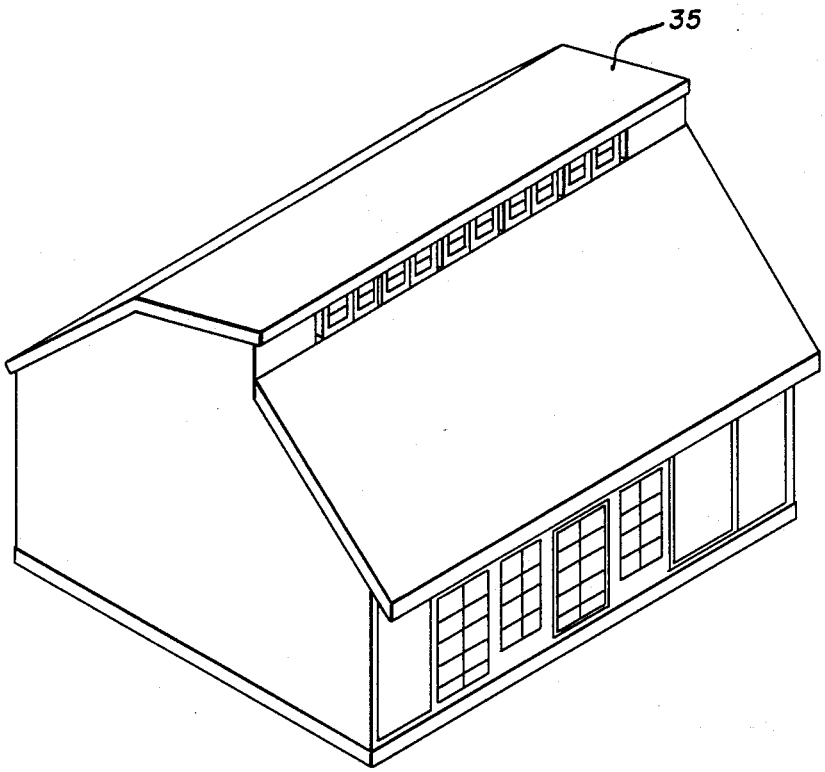
Figure 6:
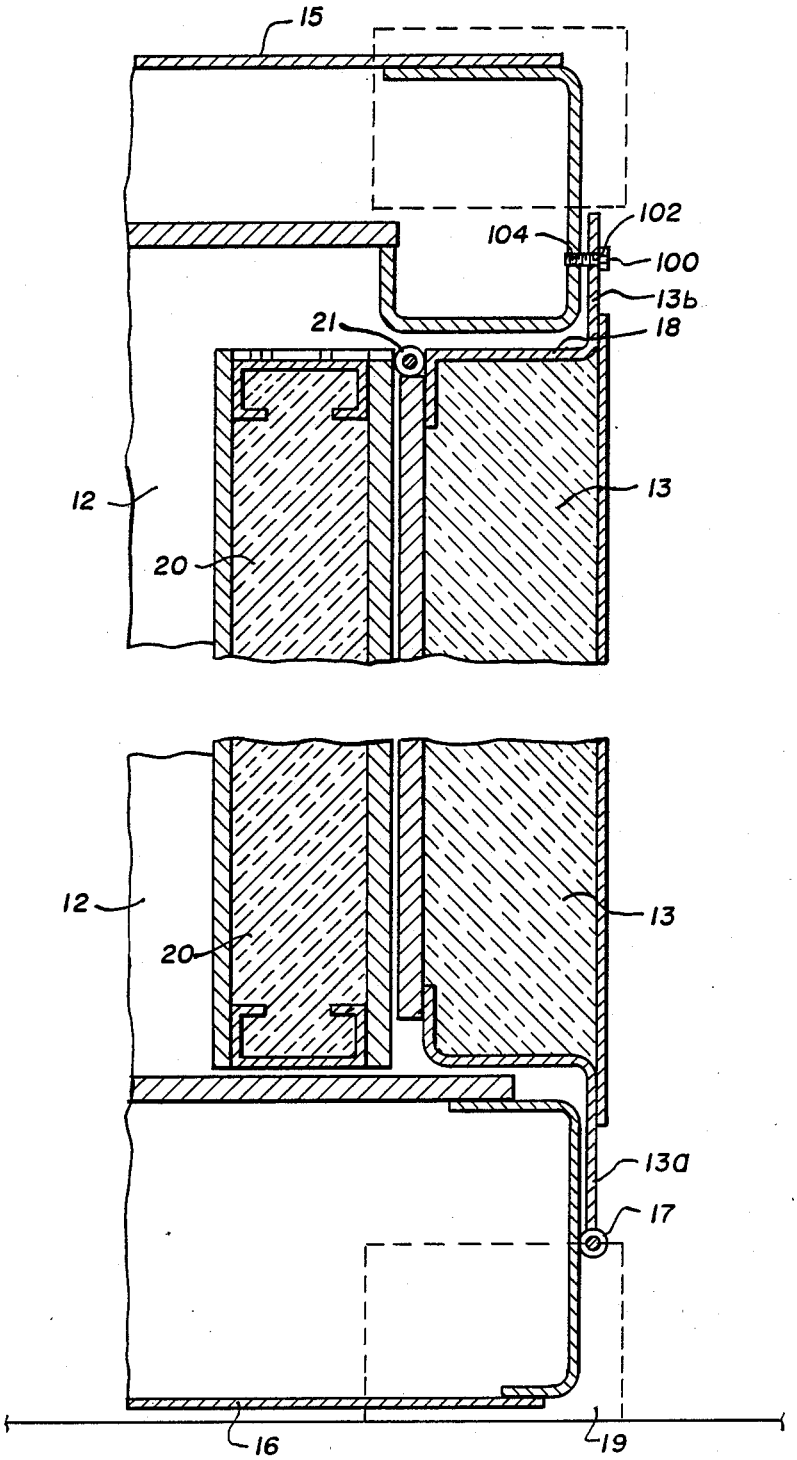

FIG. 3*a* is a sectional view of a first half of an assembled home according to a first embodiment of the present invention;

FIG. 3*b* is a sectional view of the second half of said home;

FIGS. 4*a* to 4*k* are illustrations of basic assembly steps used for erecting a house according to a second embodiment of the present invention;

FIG. 5 is a perspective view of the assembled home shown in FIGS. 3*a* and 3*b;* and FIG. 6 shows a further detail of the shipping container.

DESCRIPTION OF THE PREFERRED EMBODIMENTS

Figure 1:
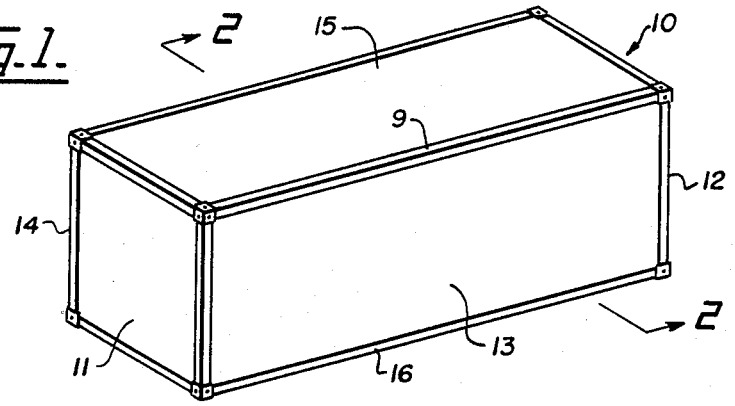
FIG. 1 is a perspective view of a standard sealand "high cube" steel shipping container.

Referring now to FIG. 1 we have shown in reference numeral 10 the unassembled containerized home of the present invention. The containerized home is provided in a standard high cube steel shipping container which can either have dimensions of either feet by twenty feet or eight feet by thirty feet and nine and a half feet high. The container has a rectangular box-like frame 9 to which are attached first and second end walls 11 and 12, first and second longitudinal side walls 13 and 14 and a top and bottom section 15 and 16 respectively. Each longitudinal side wall is hinged at its bottom longitudinal side edge to the box-like frame adjacent bottom section 16 whereas end walls 11 and 12 and top section 15 are fixedly mounted to the frame to remain in their positions and to become the main support for the structure of the house.

Figure 2:
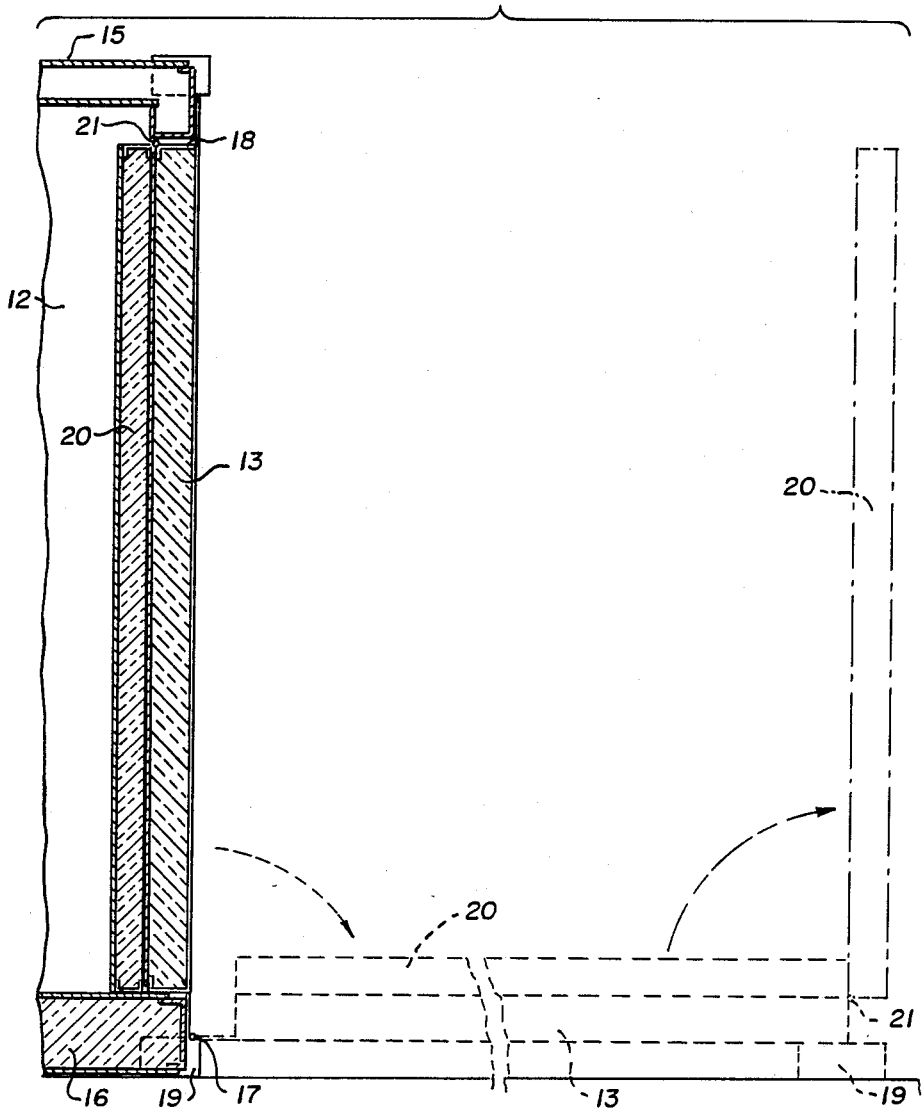
FIG. 2 is a cross section taken along lines 2—2 of FIG. 1.

As depicted in FIG. 2, longitudinal side wall 13 can be pivoted about hinge 17 to form part of the first floor plan of the house. First top longitudinal side edge 18 of side wall 13 can be supported in its open and pivoted position on house foundation 19. A first inner longitudinal side panel 20 is pivotably mounted about hinge 21 to the top side edge 18 of side wall 13. Inner panel 20 will first pivot downwardly along with side wall 13 and then upwardly to form part of the front or rear wall of the house. Second longitudinal side wall 14 will similarly pivot about its lower side edge to form another part of the floor plan of the house. Also, second inner longitudinal side panel 22 (shown in FIG. 3*a*) will fold down and up to form part of the rear or front wall of the house.

As shown in FIG. 6, there is a lip 13*a* extending up from hinge 17 and formed as an extension to wall 13. Hinge 17 and lip 13*a* are positioned and dimensioned to ensure that when wall 13 is pivoted downwardly about hinge 17 the inner surface of wall 13 becomes the upper or inner surface of the floor and is in the same plane as the upper or the inner surface of bottom section 16, as shown in FIG. 2. At the tip of wall 13, as shown in FIG. 6, there is a second lip 13*b* extending upwardly. This allows the shipping containers to be held by bolts 100 extending through clear holes 102 and lip 13*b* to engage threaded openings 104 in top section 15. In the finished structure lip 13*b* produces a gap at a lower longitudinal edge which can be sealed by members 19*a* as shown in FIG. 3*b*.

FIG. 3*a* is a sectional view of the first half of a partially completed house according to a first embodiment of the present invention. FIG. 3*b* is a sectional view of the other half of the partially completed house. As shown in FIGS. 3*a* and 3*b*, top section 15 forms part of the second floor plan. Longitudinal side wall 14 is also provided with a pivotably mounted inner panel 22 which forms part of the front wall of the house. Roof sections 24, 25 and 26 can be made of polystyrene frame composite panels 27. These composite panels are stored within container 10 shown in FIG. 1 and withdrawn from their storage places and reassembled on the construction site to complete the outer walls as well as the internal walls of the house. Other composite panels are not shown for sake of clarity. The gap formed in the floor because of lip 13*a* may be filled with a filler piece 16*a*.

Second floor section 28 of the second floor plan is also formed from composite panels, is secured to steel beam 29 of shipping container 10 (shown in FIG. 1) by means of a joist hanger 30 bolted to steel beam 29 of the container. Each house comes complete with prefabricated stairs, kitchen and bathroom cabinets and drainage piping for basins and toilet facilities. A one piece fibreglass bathtub is provided as well as a sink and toilet with the bathroom. The bathroom is completely installed with all plumbing on the inside wall completely done at the plant. Also provided is an electric in line instant hot water heater.

To facilitate the assembly, the composite panels are numbered and interlock with each other making a tight seal. The outside wall panels are bolted through the steel edges into the bottom of the panels.

Hardboard siding is installed on the exterior of the composite panels walls splines which interlock to create an efficient airlock.

On the inside a decorative faced fibreglass reinforced gypsum may be used also with some wood panelling.

These panels are finished on the inside and outside at the plant and stacked inside the container. The roof and folding side panels 20 and 22 are done the same way.

The floor of the container is fibreglass insulated and houses the electrical wiring.

Prefinished wooden half-inch doubled glazed windows are used. All doors and windows are pre-installed in panels and radiant heat is pre-installed in the panels as well.

FIGS. 4*a* to 4*k* illustrate that, the assembly of the house can be relatively simple and in general will take approximately five days with four workers using simple hand tools. FIGS. 4*b* to 4*k* illustrate an alternative embodiment to that previously described in that the front and rear walls of the house are constructed from a plurality of separate composite panels rather than using the folding panels 20 and 22 attached to container side walls 13 and 14. In this alternative embodiment, all walls except end walls 11 and 12 of the original shipping container 10 are made from composite panels. It will be appreciated that the individual panels forming the front and rear walls are not necessary in the first embodiment using folding side panels 20 and 22.

Longitudinal side walls 13 and 14 unfold from the cargo container 10 to form part of the floor plan of the house.

Side walls 13 and 14 are unfolded by loosening securing bolts 100. Container 10 and side walls 13 and 14 are then levelled before assembly is to be started. The prefabricated wall panels and fixtures are then withdrawn from the container to permit the assembly of the house. These panels are labeled to permit the easy assembly of the walls and roof sections.

Figures 4A, 4B, 4C, 4D:
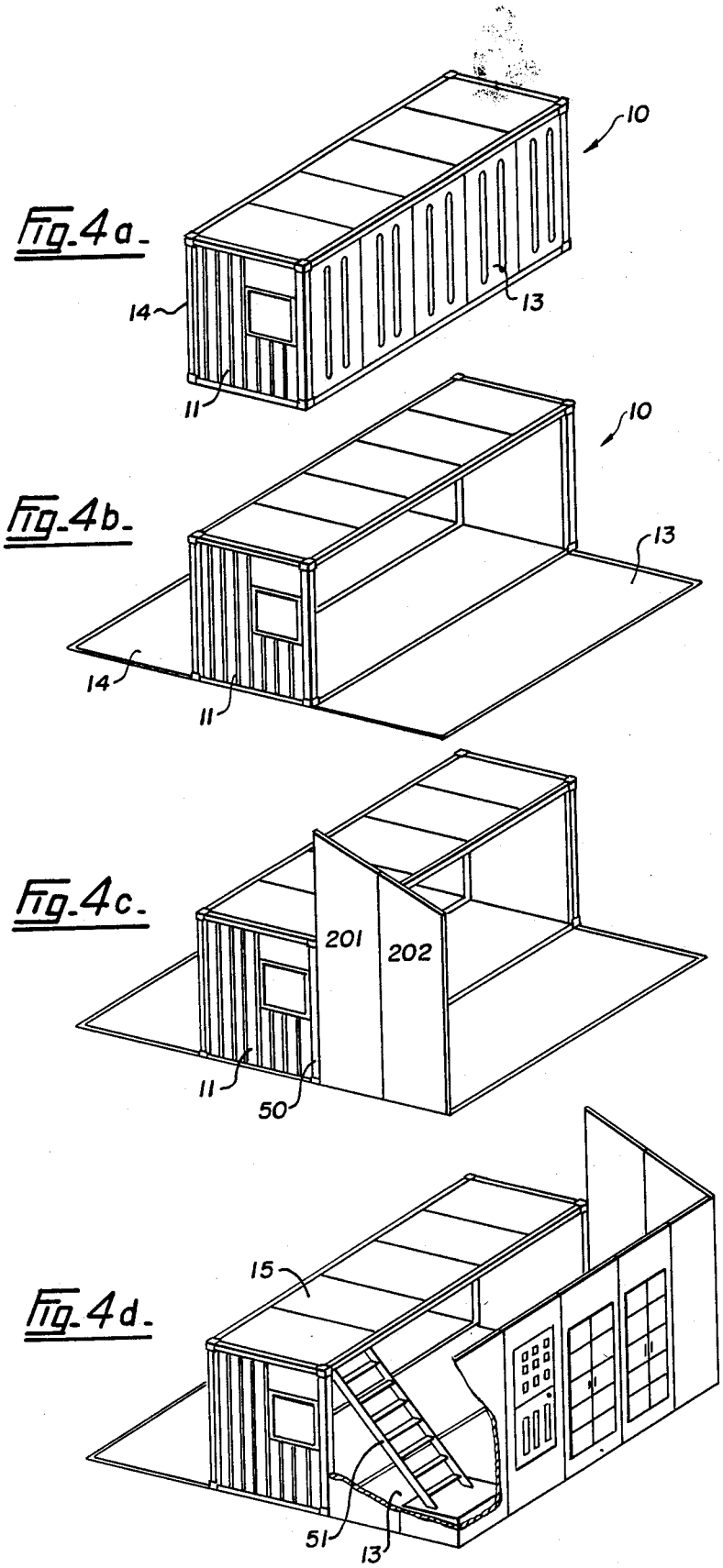

In FIG. 4*c* panels 201 and 202 are installed onto a side edge of panel 13 and panel 1 is secured to corner post 50 of end wall 11 by means of a U-shaped channel and a series of bolts. Panels 201 and 202 are secured together by means of a tongue and groove joint. In FIG. 4*d*, ladder 51 is shown secured to the floor or side wall 13 and roof 15.

Figure 4E:
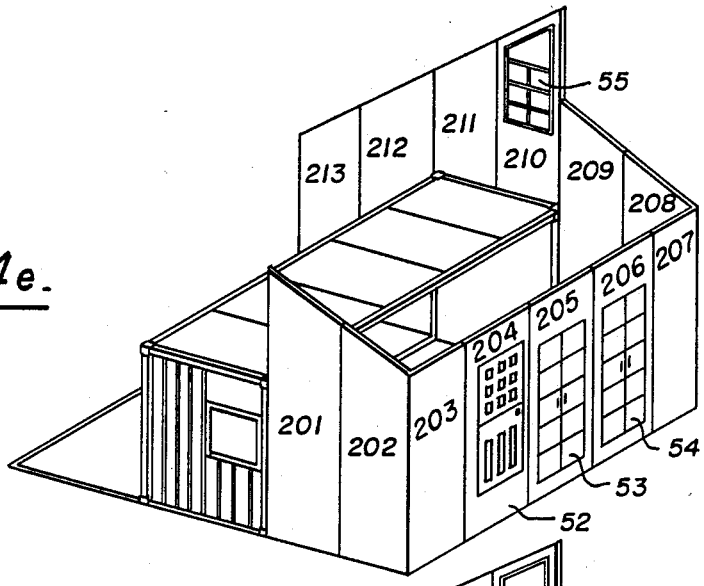
Figure 4F:
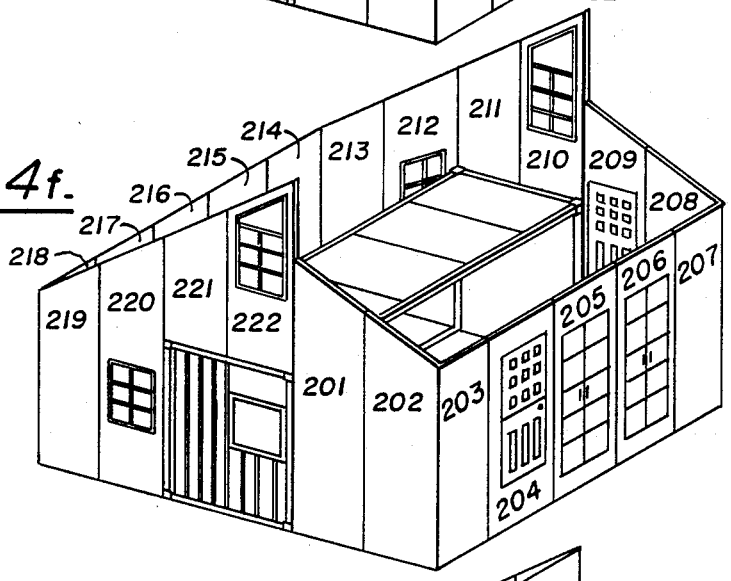

In FIG. 4*e*, panels 203 to 213 have been similarly secured to finish the front wall and a side wall of the house. Panel 204 is provided with main entrance door 52 whereas panels 205 and 206 are provided with bay windows 53 and 54 respectively. Panel 210 is provided with a window 55 which will be used as an upper bedroom window. In FIG. 4*f* panels 214 to 222 have been installed and secured in place. Panels 214 to 218 will form the rear wall of the house and panels 219 to 222 will complete the remaining side of the house. be erected in one step as described above.

Figure 4G:
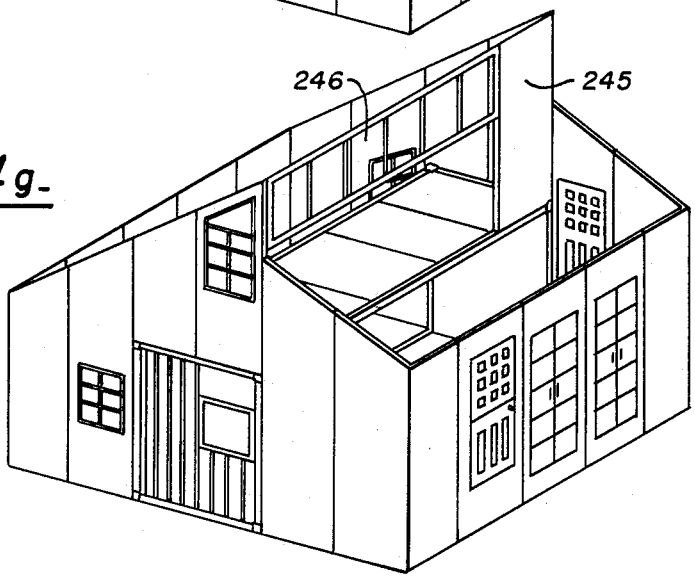
Figure 4H:
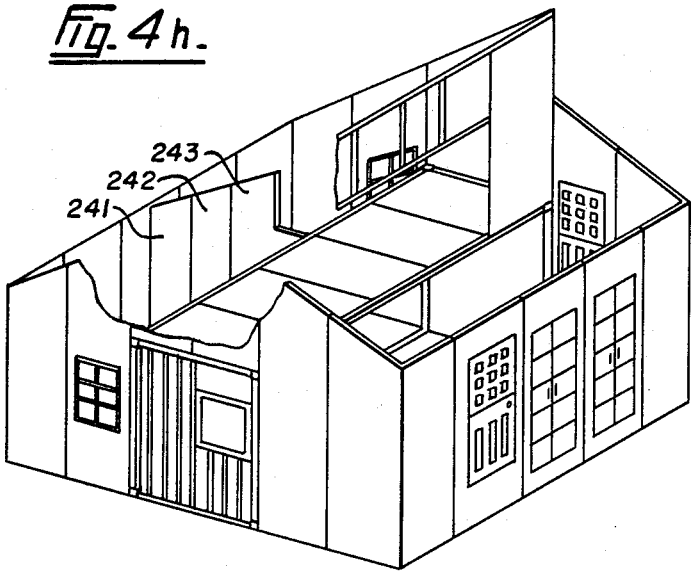

In FIG. 4*g* all side panels have been installed and secured and side panels 245 and 246 are installed to complete the installation of the exterior side walls. In FIG. 4*h*, interior panels 241, 242 and 243 are used to separate two of the main rooms of the house.

Figure 4I:
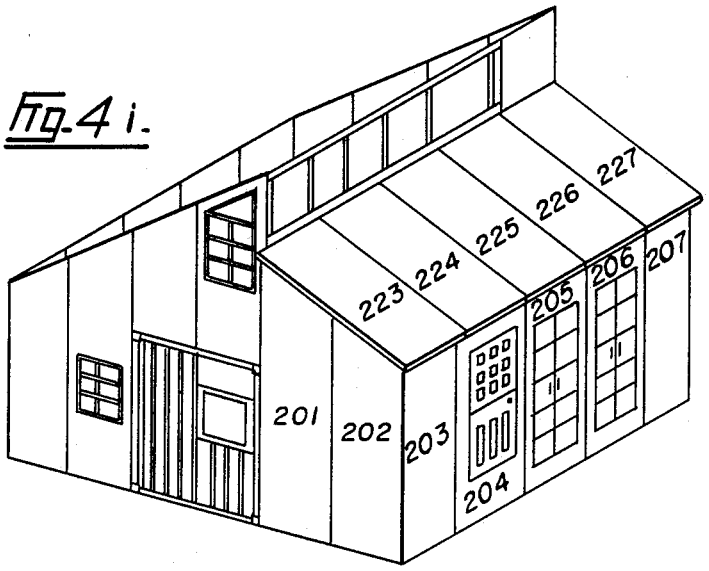
Figure 4J:
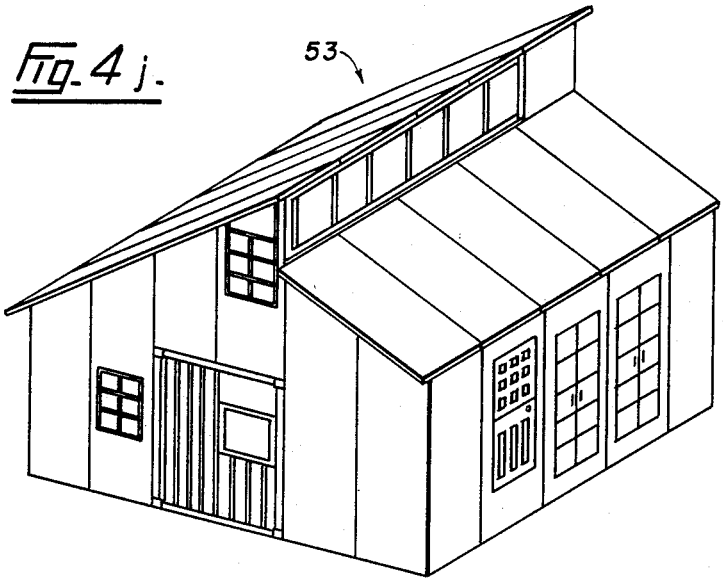

Once all interior side panels have been installed and tightly secured, roof panels 223, 224, 225, 226 and 227 are fixedly secured and positioned onto side panels 201 to 209 as is depicted in FIG. 4*i*. In FIG. 4*j* the final set of roof panels have been positioned and secured onto the rear end portion of the house and include 5 sets of panels as generally depicted by reference numeral 53.

Figure 4K:
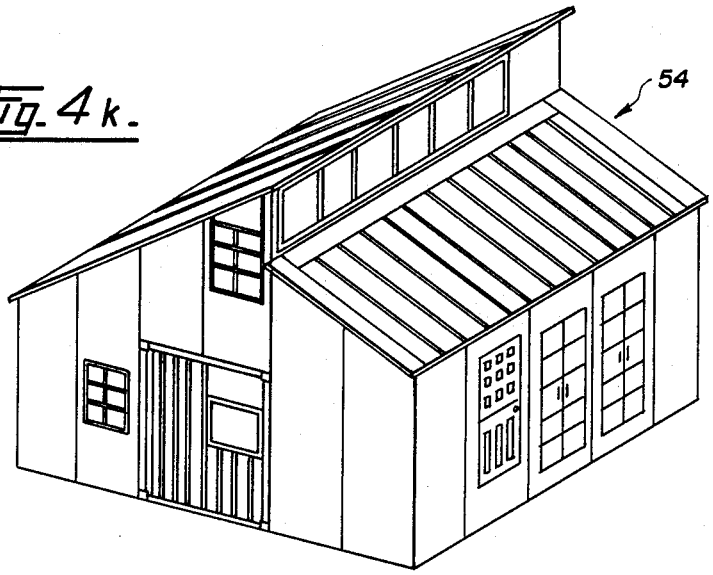

In FIG. 4*k* the side panels are shown covered with hardboard siding 54 used in providing weather protection to the composite side panels.

FIG. 5 depicts the shape of a fully assembled home according to the first embodiment of the present invention using folding side panels 20 and 22. Cross sectional views have been shown in FIGS. 3*a* and 3*b*. This house is provided with a flat roof section 35 to allow a greater living space on the second floor of the house.

I claim:

1. A containerized house comprising, in combination:

a transportable container having the size and shape of a standard cargo shipping container, said container providing the support structure of said house and having a rectangular box-like frame;

first and second longitudinal side walls mounted by hinges along first and second bottom longitudinal side edges, respectively of said frame;

first and second end walls fixedly mounted to said frame;

top and bottom sections fixedly mounted to said frame, said top section forming part of a second floor plan of said house and said bottom section forming with said first and second longitudinal side walls, when opened, a first floor plan of said house;

first and second inner longitudinal side panels mounted by hinges along first and second top longitudinal side edges of said first and second side walls, respectively, said panels forming, when opened and erected, front and rear walls of said house; and a plurality of composite panels stored in said container to form end wall sections, second floor sections, internal walls and roof sections of said house to create a fully enclosed living space.

2. A containerized home as defined in claim 1 wherein said composite panels are provided with tongue and groove joints for interlocking with an adjacent panel while creating a tight seal.

3. A containerized home as defined in claim 1 wherein said housing further comprises bathfroom facilities with drainage piping enclosed in said composite panels and said base frame.

4. A container as defined in claim 1 wherein said first and second longitudinal side walls are mounted along said first and second bottom longitudinal side edges of said frame by means of a hinge positioned centrally along said edge, said wall being connected to said hinge by means of a longitudinal lip extending from an exterior surface of said wall to said hinge such that the interior surface of said wall can lie along the same plane as said bottom section when said wall is pivoted and said exterior surface can lie along the same plane as said bottom and top longitudinal edges when closed.

5. A container as defined in claim 4 wherein said top longitudinal side edge of said side wall is further comprised of a lip extending from said exterior surface along a plane defined by said surface.

6. A container as defined in claim 5 wherein said container further comprises joist hangers adapted to be placed along said frame to mate said frame with said composite panels.

7. A containerized house comprising, in combination:

a transportable container having the size and shape of a standard cargo shipping container, said container providing the support structure of said house and having a rectangular box-like frame;

first and second longitudinal side walls mounted by hinges along first and second bottom longitudinal side edges, respectively of said frame;

first and second end walls fixedly mounted to said frame;

top and bottom sections fixedly mounted to said frame, said top section forming part of a second floor plan of said house and said bottom section forming with said first and second longitudinal side walls, when opened, a first floor plan of said house;

a plurality of composite panels stored in said container to form front and rear walls, end wall sections, second floor sections, internal walls and roof sections of said house to create a fully enclosed living space.

* * * * *

UNITED STATES PATENT AND TRADEMARK OFFICE

CERTIFICATE OF CORRECTION

PATENT NO. : 4,891,919

DATED : January 9, 1990

INVENTOR(S) : James W. Palibroda

It is certified that error appears in the above-identified patent and that said Letters Patent is hereby corrected as shown below:

Column 2, line 29, "either" should be -- eight --.
Column 3, line 21, insert -- and -- after "panels".
Column 3, line 50, delete the comma after "that".

Column 4, lines 22, 23, delete "be erected in one step as described above".

Column 5, line 8, "bathfroom" should be -- bathroom --.

Signed and Sealed this

Ninth Day of July, 1991

*Attest:*

*Attesting Officer*

HARRY F. MANBECK, JR.

*Commissioner of Patents and Trademarks*